US007257885B2

(12) United States Patent
Watkins et al.

(10) Patent No.: US 7,257,885 B2
(45) Date of Patent: Aug. 21, 2007

(54) APPARATUS FOR FASTENING SAND CORE ELEMENTS

(75) Inventors: Gregory D. Watkins, Indianapolis, IN (US); Donald G. Wildrick, Indianapolis, IN (US); Daniel Davis, Indianapolis, IN (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 534 days.

(21) Appl. No.: 10/849,996

(22) Filed: May 20, 2004
(Under 37 CFR 1.47)

(65) Prior Publication Data

US 2005/0044705 A1 Mar. 3, 2005

Related U.S. Application Data

(63) Continuation-in-part of application No. 10/210,518, filed on Aug. 1, 2002, now Pat. No. 6,865,806.

(51) Int. Cl.
*B23P 19/00* (2006.01)
*B23P 21/00* (2006.01)

(52) U.S. Cl. ..... 29/700; 29/709; 29/712; 29/714; 29/787; 29/798; 29/407.09; 29/407.1; 700/95

(58) Field of Classification Search ..... 29/407.01, 29/407.05, 407.09, 407.1, 700, 709, 712, 29/714, 787, 795, 798, 816, 818; 700/95, 700/108, 112, 113
See application file for complete search history.

(56) References Cited

U.S. PATENT DOCUMENTS

| | | | |
|---|---|---|---|
| 3,554,271 | A | 1/1971 | Goss |
| 5,119,881 | A | 6/1992 | Cagle |
| 6,435,259 | B1 | 8/2002 | Baker et al. |
| 2004/0020048 | A1 | 2/2004 | Wildrick et al. |

*Primary Examiner*—Jermie E. Cozart
(74) *Attorney, Agent, or Firm*—Susan L. Lukasik; Elias P. Soupos; Jeffrey P. Calfa

(57) ABSTRACT

Core sand elements are rapidly and reliably retained by driving one or more smooth surface fasteners, such as staples, nails or brads, into the core elements. In production, after the core sand elements are assembled, the core assemblies are placed on a moving belt conveyor, movement of core assemblies on the moving belt conveyor is intercepted and momentarily stopped at a fastening station and the momentarily stopped core assemblies are lifted from the moving belt conveyor to a fastening position at which a plurality of smooth surface fastener guns are moved into position against the core assembly and located to simultaneously drive a plurality of smooth surface fasteners into the core elements of the core assembly. In preferred such methods, the smooth surface fastener comprises a staple with two smooth surface tines connected by a crown and the staple is positioned for insertion of one tine into each of two adjacent core elements with the crown of the staple spanning the interface between the two core elements.

5 Claims, 5 Drawing Sheets

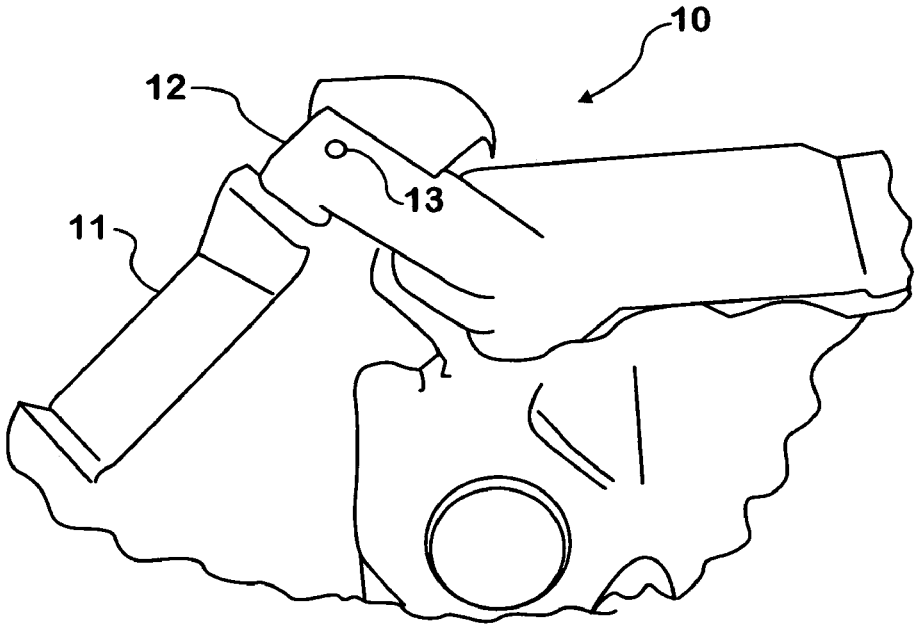
FIG. 1
FIG. 4
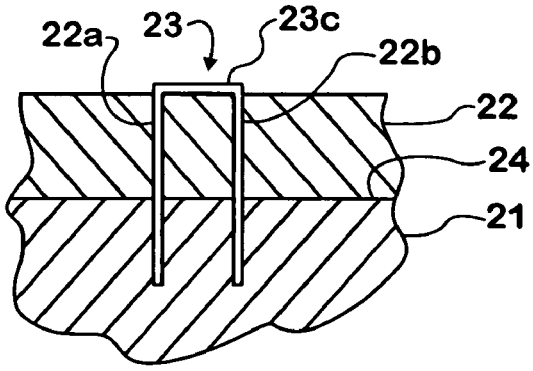
FIG. 2
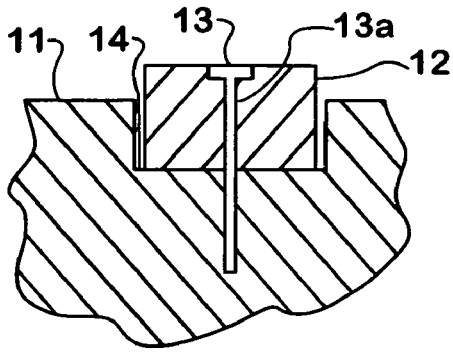

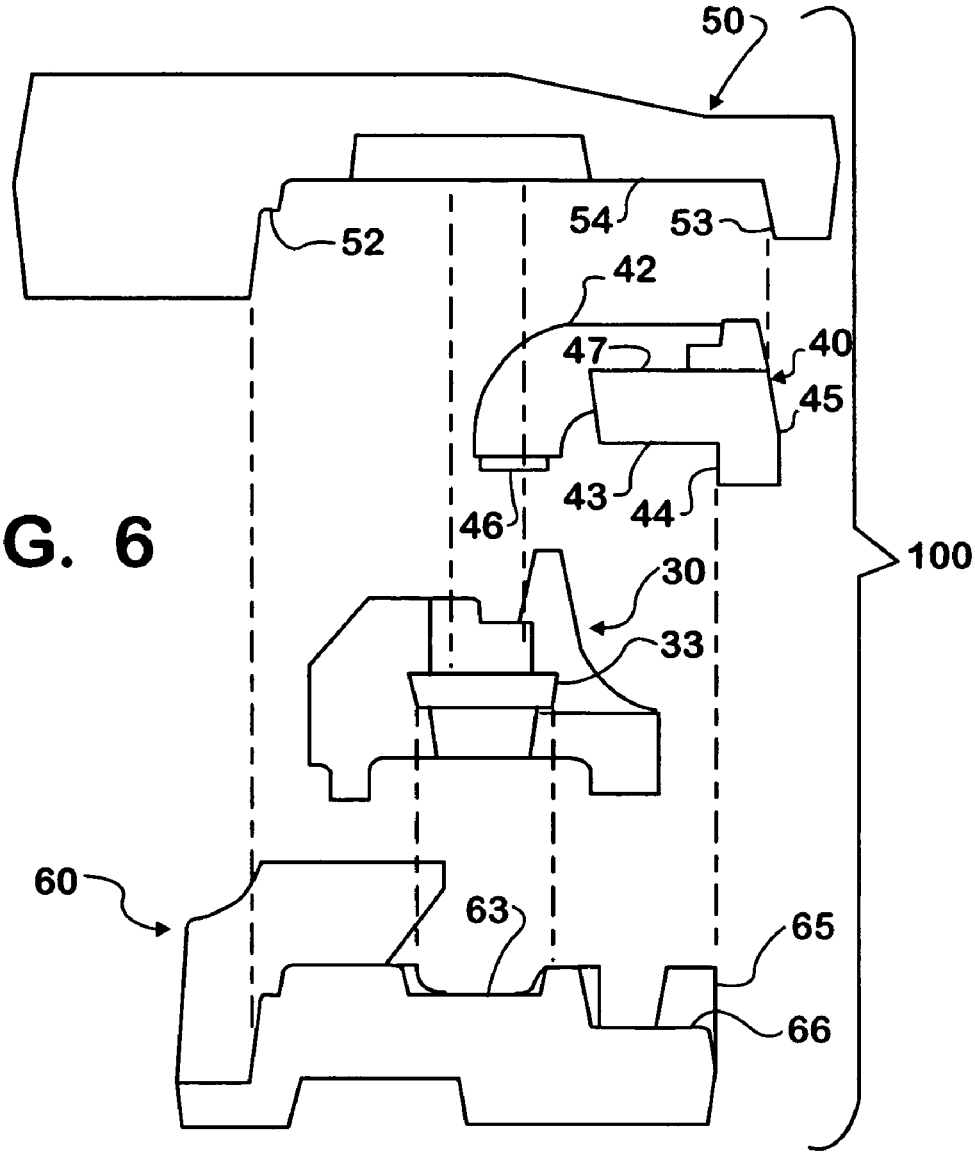
FIG. 6
FIG. 7
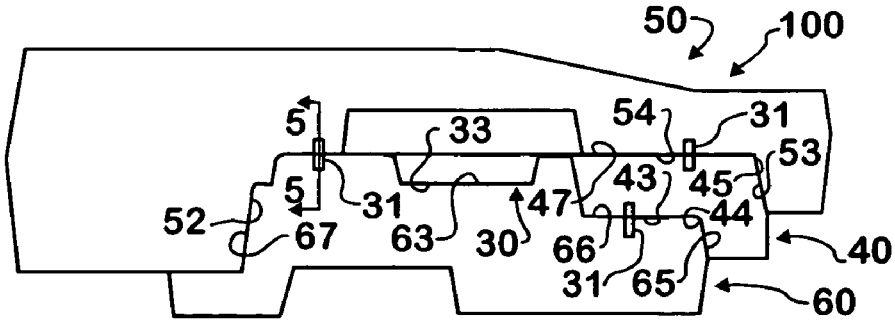

APPARATUS FOR FASTENING SAND CORE ELEMENTS

RELATED APPLICATIONS

The present patent document is a continuation-in-part of U.S. patent application Ser. No. 10/210,518, filed Aug. 1, 2002, now U.S. Pat. No. 6,865,806, which is hereby incorporated by reference.

FIELD OF THE INVENTION

This invention relates to methods and apparatus for casting parts for internal combustion engines, and more particularly to methods and apparatus of assembling and fastening core elements of core assemblies.

BACKGROUND OF THE INVENTION

The manufacture of castings for internal combustion engines poses difficult manufacturing problems. For example, the cylinder head of an internal combustion engine, whether for a spark-driven gasoline internal combustion engine or a compression-ignition diesel engine, is a complex article of manufacture with many requirements. A cylinder head generally closes the engine cylinders and contains the many fuel explosions that drive the internal combustion engine, provides separate passageways for the air intake to the cylinders and for the engine exhaust, carries the multiplicity of valves needed to control the air intake and engine exhaust, provides a separate passageway for coolant to remove heat from the cylinder head, and can provide separate passageways for fuel injectors and the means to operate fuel injectors.

The walls forming the complex passageways and cavities of a cylinder head must withstand the extreme internal pressures, temperatures and temperature variations generated by the operation of an internal combustion engine, and must be particularly strong in compression-ignition diesel engines. On the other hand, it is desirable that the internal walls of the cylinder head, particularly those walls between coolant passageways and the cylinder closures, permit the effective transfer of heat from the cylinder head.

It is also important that all castings for internal combustion engines include minimal metal to reduce their weight and cost. The countervailing requirements of reliable internal combustion engine parts make casting such parts difficult. Furthermore, these complex parts are manufactured by the thousands and assembled into vehicles that must operate reliably under a variety of conditions. Consequently, the casting of internal combustion engine parts has been the subject of the developmental efforts of engine and automobile manufacturers throughout the world for years.

Cylinder heads are most generally manufactured by casting them from iron alloys. The casting of the cylinder head portion that closes the cylinders, carries the intake and exhaust valves and fuel injectors and provides the passageways for the air intake, exhaust and coolant requires a mold carrying a plurality of core elements. To provide effective cooling of the cylinder head and effective air intake and exhaust from the cylinders of the internal combustion engine, the passageways for the air intake and exhaust are best interlaced with the coolant passageways within the cylinder head portion. The cavities for coolant, air intake and exhaust must, of course, be formed by core elements within the mold that can be removed when the casting metal solidifies.

Such core elements are formed from a mixture of core sand and a curable resin, which, when cured, retains the shape imposed on it prior to curing, and after a casting solidifies, the core sand and resin residue are removed from the casting.

As a result of recent developments, core assemblies are provided by a plurality of core elements that have interengaging surfaces to locate the plural core elements in the core assembly. For example, head core assemblies can be formed by the assembly of a one-piece coolant jacket core, a one-piece exhaust core, and a one-piece air intake core that interengage during their assembly; however, to maintain such an assembly together as a unit during post-assembly handling and casting, the core elements must be fastened together. Because of the high rate of manufacture of internal combustion engines and the stringent requirements for their reliability, such fastening methods must be both rapidly effected and reliable. In the past, adhesive and/or screws have been used to fasten core elements together to maintain the integrity of the core assembly during its handling and during pouring of the casting.

The use of an adhesive requires an adhesive that can be easily spread on the core elements, that will set within the shortest possible time, that will hold the core elements together as one piece and maintain their position during the casting process, and that may be removed from the casting after the casting metal solidifies. This method results in substantial costs and opportunities for unreliable castings because of a potentially unreliable interface between the core elements. The adhesive materials may separate or otherwise become degraded in storage. It is also necessary that workmen apply the adhesive correctly so that the adhesive reliably maintains the core elements together during casting and is not spread onto an exposed casting surface. Furthermore, this method requires time for applying the adhesive, assembling the core elements together and allowing the adhesive to set before the core elements can be used for casting, and it introduces into the mold a foreign element in the form of an adhesive that may evolve gas that may become trapped in the solidified casting and cause areas of possible failure.

Because of the difficulties of using adhesive to fasten core elements together, screws have been used to fasten the core elements of core assemblies together. Although the use of screws to fasten core elements together provides a more predictable assembly of the core elements than adhesive, the use of screws requires the installation of accurately sized pins in the mold-form for the core to provide accurately sized holes in the core to accept the screws. Such pins in the mold-form become eroded by the abrasive core sand and bent in use, resulting in holes in the core that are too small or that cannot accept screws from an automatic installation station. As a result, screws frequently fail to properly engage the core sand core elements and to provide holding engagement of the core sand elements as a result of core sand stripping during their installation.

BRIEF SUMMARY OF THE INVENTION

The invention provides a rapid and reliable method of fastening assembled core elements together without the use of the adhesives or screws. In the invention, core sand elements are retained in an assembly by driving one or more smooth surface fasteners into the core elements. A method of the invention comprises positioning at least two core elements in a core assembly, positioning a smooth surface fastener for entry into the at least two core elements, and driving the smooth surface fastener into the two core elements to fasten them in the core assembly. In a preferred method of the invention, the smooth surface fastener comprises a staple with two smooth surface tines connected by a crown of the staple spanning the interface between the two core elements. In another preferred method of the invention, a plurality of core elements are assembled into a core assembly, and a fastening fixture comprising a plurality of staple or nail guns is positioned adjacent the core assembly with the plurality of staple or nail guns located for insertion of staples or nails into the core elements, and a plurality of air-driven staples or nails are simultaneously driven into the core elements of the core assembly to fasten the core assembly together.

In a preferred production method and apparatus, assemblies of sand core elements are formed and placed on a moving belt conveyor and carried to a fastening station. At the fastening station, the assemblies of sand core elements are stopped and lifted from the moving belt conveyor and retained in a fastening position above the moving belt conveyor where a plurality of smooth surface fastener guns are moved into locations against the core element assemblies for insertion of a plurality of smooth surface fasteners into the sand core elements. Preferably, each smooth surface fastener gun is an automatically operable staple gun and is positioned at plural locations for the insertion of more than a single staple, and is preferably located so that one tine of each staple is inserted into one sand core element and the other tine of the staple is inserted into a second adjacent sand core element with the crown of the staple lying across the interfacing sides of the adjacent sand core element to retain them together. Upon completion of the fastening operation by insertion of all the needed smooth surface fasteners, the fastened assemblies of core elements are lowered onto the moving belt conveyer and are allowed to be carried from the fastening station by the moving belt conveyer.

The smooth surface fasteners may be nails, brads or staples, preferably metal, and the method may include driving such smooth surface fasteners into the assembled core elements with a staple or nail gun, which is preferably driven by factory-compressed air.

Other steps, features and advantages of the invention will be apparent to those skilled in the art from the drawings and more detailed description of the best mode of the invention that follows.

BRIEF DESCRIPTION OF THE DRAWINGS

FIG. 1 is a partial perspective view of two core elements fastened together through the use of the invention;

FIG. 2 is a partial cross-sectional view of two core elements fastened together using a nail in the invention;

FIG. 4 is a partial cross-sectional view showing two core elements fastened together through the use of a staple in the invention;

FIG. 6 is an exploded side view of the core elements of a core assembly for an internal combustion engine head core assembly;

FIG. 7 is an end view of the head core assembly of FIG. 6 fastened together with the invention;

FIG. 10 being a view from above the apparatus taken at a plane at line 10-10 of FIG. 11, FIG. 11 being a view from the side of the apparatus taken at a planes corresponding to line 11-11 of FIG. 10, and FIG. 12 is a view of the exit end of the apparatus.

DETAILED DESCRIPTION OF THE BEST KNOWN MODE OF THE INVENTION

Figure 3:
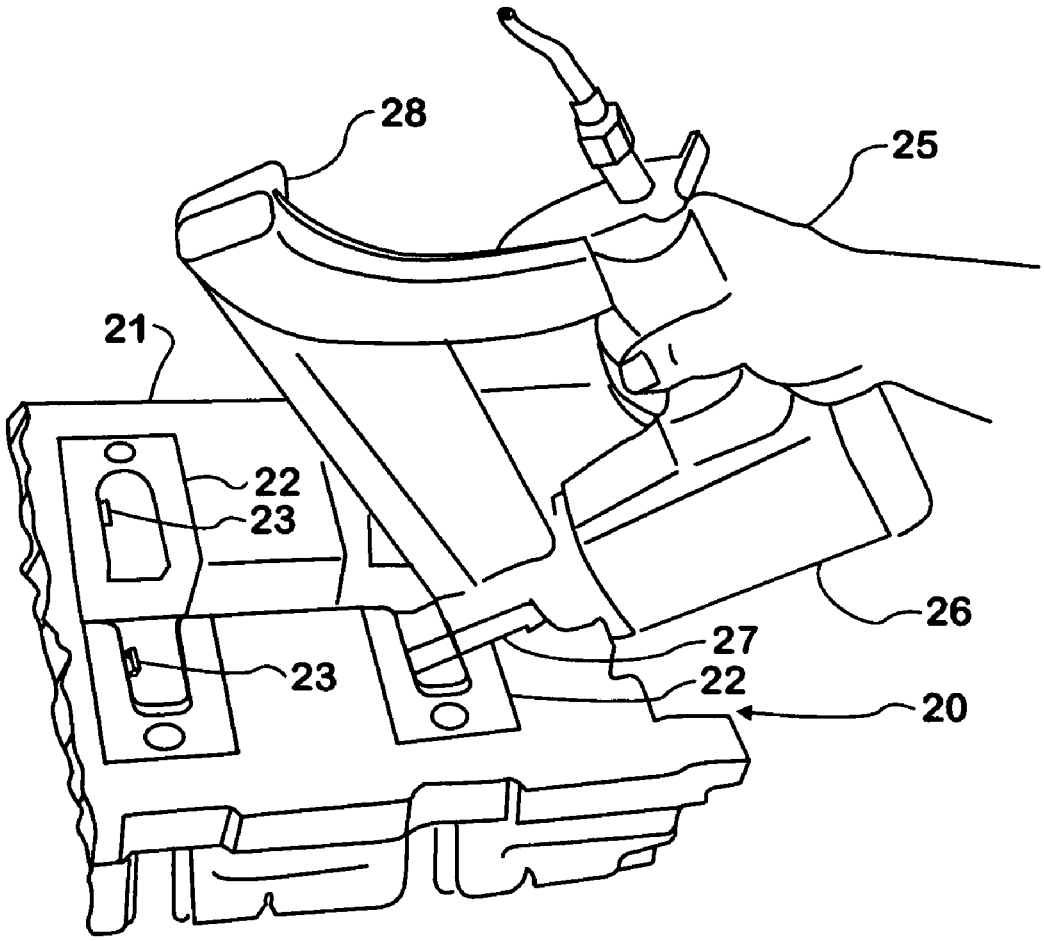
FIG. 3 is a partial perspective view illustrating a method of fastening core elements together with staples and a staple gun.

FIG. 1 illustrates an assembly 10 of the invention comprising core elements 11, 12, both of which are formed by core sand and a cured resin, such as the resin used in the phenolic urethane cold box process that is well-known in the art, typically comprising a phenolic resin and an isocyanide resin, mixed in the ratio of 55 parts to 45 parts, respectively, and cured with a triethylamine catalyst after formation of the core elements 11, 12. Core element 11 comprises a front-end core, and core element 12, which is substantially smaller than core element 11, comprises a water crossover core. In accordance with the invention, the core elements 11, 12 are fastened together by a nail 13, which is driven through the small core element 12 into the larger core element 11.

FIG. 2 is a partial cross-sectional view of the assembly 10, taken at a plane through the center of the nail 13. As illustrated in FIG. 2, the shank 13*a* of nail 13 has sufficient length to pass completely through the core element 12, the interface 14 between core elements 11 and 12 and well into the body of the core element 11. In this method, nail 13 has a length of about 2 inches and penetrates into core element 11 a distance of about ½ inch to ¾ inch. Because this core assembly 10 needs to be fastened together only until it is placed in a larger containing core assembly, only one nail is necessary to fasten the water crossover core 12 to the front-end core 11. The smooth-sided shank 13*a* frictionally engages the surfaces it forms in core elements 11, 12 to retain their engagement at the interface 14 and prevent the lateral movement of core elements 11, 12 with respect to each other. Furthermore, when the nail is driven into the core assembly 10 with a nail gun, it is believed that the adhesive resin, which retains the nails to be driven in a stick assembly for insertion into the nail gun and adheres to the nail as it is driven, is melted by the friction between the moving nail and the core sand and solidifies to assist in retention of the nail 13 and core elements 11 and 12 in the assembly 10.

FIG. 3 illustrates a partial perspective view of the preferred fastening method of the invention using staples and a staple gun to drive the staples into the assembled core elements. As well known in the art, a staple has two smooth surface tines interconnected by a crown. As illustrated in FIG. 3, core assembly 20 comprises a crankcase core 21 formed from core sand and a plurality of gating core inserts 22 formed from core sand which are being fastened together using a plurality of staples 23 as smooth-sided fasteners. In the assembly method, a workman uses his hand 25 to position the staple gun 26 so the barrel 27 of the staple gun 26 is held against one of the core inserts 22 in a position to drive the staple 23 through the core insert 22 and into the frame core 21 to retain the core insert in the frame core. The staple gun preferably contains a cartridge 28 containing a multiplicity of staples 23 that are retained in a "stick" by an adhesive resin and automatically fed to the barrel 27 to be driven by an air-actuated cylinder within the staple gun 26, which is triggered by the workman's hand.

FIG. 4 illustrates the fastening of core elements 21, 22 together using staple 23 as illustrated in FIG. 3. The tines 22*a* and 22*b* of the staple 23 have sufficient length to pass through gating core element 22, the interface 24 between core elements 21 and 22, and well into the core element 28; however, the staple driver 26 is adjusted so the crown 23*c* of the staple has no significant penetration into the core element 22 to avoid damage to core element 22. As with the nail illustrated in FIGS. 1 and 2, the smooth sides of the tines 22*a* and 22*b* of the staple 23 frictionally engage core elements 21 and 22, maintaining their contact at their interface 24 and preventing the lateral movements of core elements 21, 22 with respect to each other. It is believed that the adhesive resin that maintains a plurality of staples in a stick for insertion into the staple gun 26 is melted by the friction of insertion and solidified to assist in retention of the staple 23 and core elements 21 and 22 in the core assembly.

In the use of the invention illustrated by FIG. 3, the gate cores 22 are attached to the crank case core with two 7/16-inch crown staples in each gate core element, and in the operation of the invention illustrated in FIG. 1, the water cross-over core component 12 can be attached to the front end core 11 with one 2-inch finishing nail. It is believed that a smooth surface fastener should be long enough to penetrate a core element about one-half inch and preferably about ¾ inch or more for satisfactory fastening.

Figure 5:
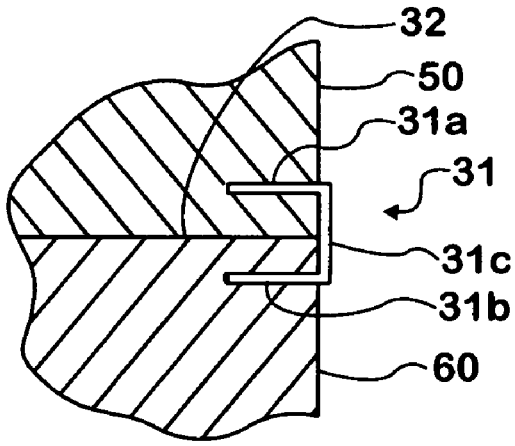
FIG. 5 is a partial cross-sectional view illustrating a preferred use of a staple in the invention.

FIG. 5 is a partial cross-sectional view of a preferred use of a staple fastener 31 to fasten two core elements (e.g., 50, 60) together in a core assembly, as further set forth in the description of FIGS. 6 and 7 below. As illustrated in FIG. 5, in a preferred use of staples in the invention, one tine 31*a* of staple 31 penetrates one core element (e.g., 50) and the second tine 31*b* of the staple penetrates a second core element (e.g., 60) with the crown 31*c* of the staple 31 spanning the interface 32 between the two core elements. In the preferred method of the invention, the penetration of the two tines 31*a* and 31*b* and the crown 31*c* retain the two core elements (e.g., 50, 60) in an assembly. Where the staples are driven into the core elements by a staple gun, the staple gun is adjusting so the crown 31*c* of the staple has no significant impact on the core elements. FIGS. 6 and 7 further illustrate this preferred method of the invention.

FIG. 6 is an exploded view, illustrating, as an example, head core elements that can be fastened together in a head core assembly with the invention.

In a casting cylinder head with a method of the invention, for example, a one-piece coolant jacket core 30 having a plurality of core supporting and positioning surfaces and a frame core 60 having a plurality of core supporting and positioning surfaces may be provided, and the one-piece coolant jacket core 30 may be supported and positioned on the frame core 60 by engaging corresponding core supporting and positioning surfaces of the coolant jacket core and the frame core. As shown in FIG. 6, the coolant jacket core 30 may be lowered into the frame core 60 with a supporting and positioning surface (e.g., 33) of the one-piece coolant jacket core engaged with supporting and positioning surface (e.g., 63) of the frame core 60. A one-piece exhaust core 40 having a plurality of exhaust passageway-forming portions, such as 42, with a plurality of core supporting portions, such as 46, may be inserted into the assembled frame core 60 and coolant jacket core 30 by extending the elongated exhaust passage-forming portions (e.g., 42) which project transversely outwardly from the exhaust core, through openings (not shown) in the coolant jacket core 30, and the one-piece exhaust core 40 may be supported and positioned in the assembly by engaging the plurality of corresponding core supporting and engaging surfaces of the exhaust core (e.g., 43, 44) and the frame core (e.g., 65, 66). An intake core 50, having a plurality of core supporting and positioning surfaces adapted to engage the frame core 60, the coolant jacket core 30 and the exhaust core 40, completes a core assembly 100 with the core elements positioned together for formation of a head core assembly. The intake core 50 provides a plurality of air intake passage-forming portions (e.g., 54) that extend transversely outwardly from its frame, and the intake core 50 is located on the assembled frame core 60, coolant jacket core 30 and exhaust core 40 by a plurality of core supporting and positioning surfaces (e.g., 52, 53, 54) engaging the corresponding core supporting and positioning surfaces of the frame core (e.g., 67), coolant jacket core (e.g., 33), and exhaust core (e.g., 45, 47), locking the core elements by their engagement into an integral unit. Core assemblies with interlocking core elements are further described in U.S. Pat. No. 5,119,881. With the invention, the core elements 30, 40, 50, 60 are fastened together in the core assembly 100 by a plurality of staples 31, driven as indicated in FIG. 5, into core elements 50 and 60, 40 and 60, and 40 and 50, respectively.

Figure 8:
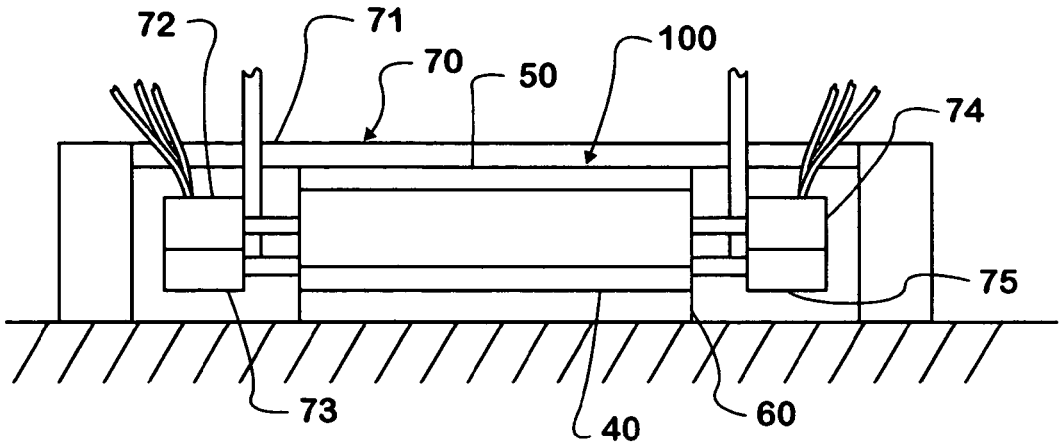
FIG. 8 is a side view of the assembled head core assembly of FIG. 7 to illustrate a fastening tool for fastening the head core elements of FIG. 6 together, as illustrated in FIG. 7.

For example, the core elements 30, 40, 50, 60, as illustrated in FIG. 8, may be fastened together by providing a fastening fixture 70 comprising a frame 71 placed adjacent the core assembly 100. The frame will position a plurality of air-driven staple guns 72, 73, 74, 75 to simultaneously drive the plurality of staples 31 horizontally into the opposite ends of core elements (several staple guns are not visible in FIG. 8). As indicated, the staple guns 72, 73, 74, 75 are positioned so that staples 31 are simultaneously driven into the opposite ends of the assembled core elements 100 with one tine in core element 50 and one tine in core element 60, with one tine in core element 40 and two in core element 50, and with one tine in core element 40 and one tine in core element 60, with their crowns spanning the interfaces between core elements 50 and 60, 40 and 50, and 40 and 60, respectively, to hold the core assembly 100 together.

A production line incorporating the invention can include, for example, a first station in which a mixture of core sand and resin is placed in one or more mold forms and compressed and cured to form the core sand elements of the core assembly, such as the cylinder head. For example, at such a first station, the elements of a core assembly for casting a cylinder head can form the one-piece coolant jacket core 30, frame core 60, exhaust core 40, and intake core 50, illustrated in FIG. 6. From the first core-forming station, the core elements can be transferred to a second core-assembly station upon removal from the core-forming molds by conveying or transporting means well known in the art. At the second core-assembly position, the core elements may be assembled by hand or by a robot programmed to position and interfit the core elements in a manner such as that described above. The resulting core-assembly can then be transferred from the core assembly station to a moving belt conveyor, for example by a robot, which picks up the core assemblies and places them on the moving belt conveyor. The core assemblies are removed from the moving belt conveyor, automatically provided with fasteners to hold the core elements in position, and replaced on the moving belt conveyor for completion of the casting operation.

Figure 9:
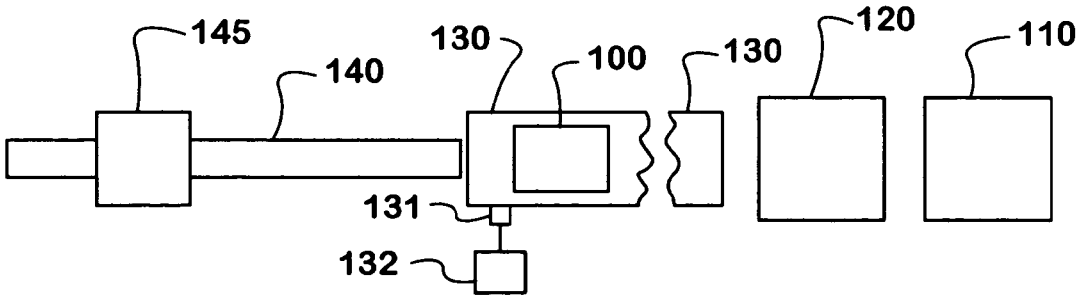
FIG. 9 is a block diagram of one exemplary production line for incorporation of the invention

FIG. 9 illustrates an example of one production line in which the invention may be practiced. In such a production line, the sand core elements of an internal combustion engine part, such as a cylinder head, are molded from core sand and resin at a core element-forming station 110 in a manner well known to those skilled in the art. The sand core elements are next removed from their molds and can be assembled by hand, but preferably by robots, at a core assembly station 120. After the assembly of sand core elements is completed, the core assemblies 100 can then be transferred again by hand, but preferably by robots, to a moving belt conveyor, shown in part as element 130, for transportation to a fastening station 145.

In practicing the invention, the core assemblies 100 are transferred from the moving belt conveyor 130 to a second, narrower moving belt conveyor 140, which carries the core assemblies 100 through the fastening station 145. Since the fastening operation of the invention may take up to fifteen seconds to complete, a core assembly sensor 131 is placed adjacent the moving belt conveyor 130 at the place where the core assemblies 100 are transferred to the second narrower moving belt conveyor 140. The core assembly sensor 131 will, through a control 132, operate the drive for the moving belt conveyor 130, stopping the moving belt conveyor 130 briefly, if necessary, to ensure that the time interval between core assemblies arriving at the fastening station 145 permits completion of the fastening operation without interference from core assemblies that follow.

In the invention, the movement of the core assemblies 100 is intercepted and momentarily stopped at the fastening station 145, the momentarily stopped core assemblies 100 are lifted from the moving belt conveyor 140 to a predetermined fastening position 146 above the moving belt conveyor 140 at which a plurality of smooth surface fastener guns are moved into position against the core assembly and located to simultaneously drive a plurality of smooth surface fasteners into the core elements of the core assembly 100. Preferably the smooth surface fasteners are staples which are inserted into the core elements, in the manner illustrates in FIGS. 5 and 7, so that one tine of each staple is driven into one core element and the other tine of each staple is driven into an adjacent core element, with the crown of the staple lying across the interface between the two adjacent core elements so that with such an insertion of the plurality of staples, the core elements are retained in position in the core assembly 100 during subsequent handling, and pouring of molten metal into the cavity formed by the core assembly. Upon completion of the fastener insertion into the core assemblies, the core assemblies are lowered onto the moving belt conveyor 140 and are moved thereby downstream where molten metal is poured into the cavity formed by the core assembly for the formation of, for example, an internal combustion engine cylinder head.

Figure 10:
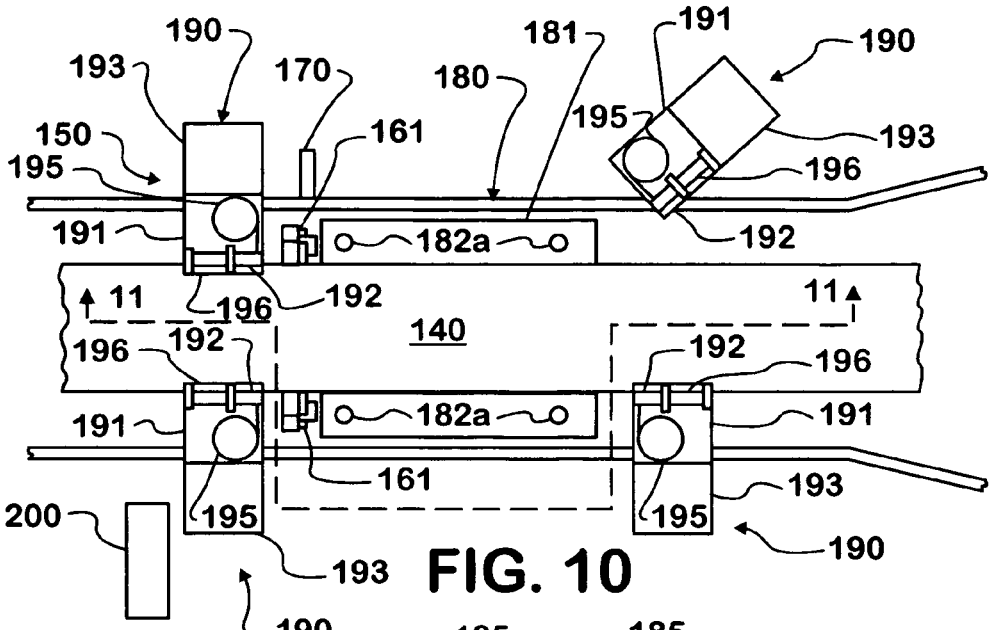
FIGS. 10-12 are simplified diagrammatic orthogonal views illustrating the principal parts of a preferred apparatus to practice the invention.
Figure 11:
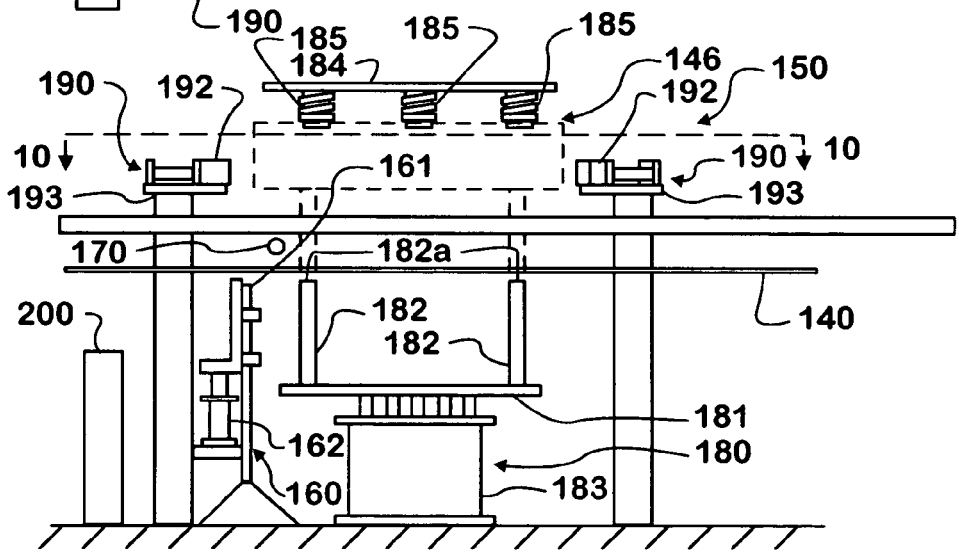
Figure 12:
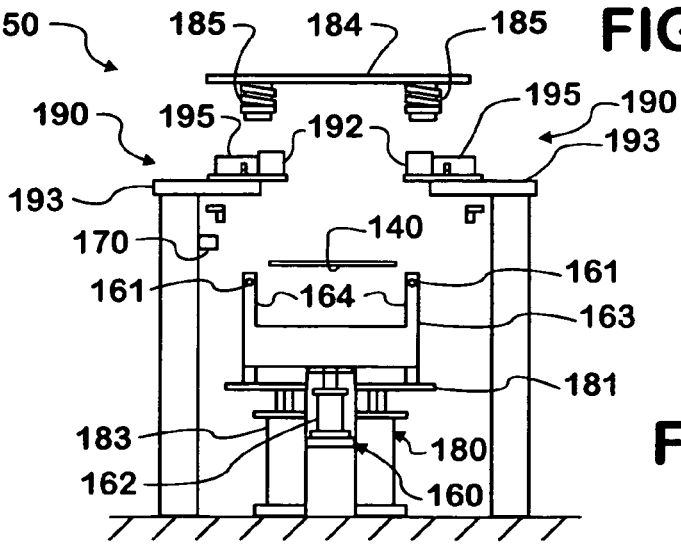

FIGS. 10-12 diagrammatically illustrate the principal parts of one preferred apparatus 150 for practicing the invention. In order to more clearly illustrate the invention, supporting structural parts, hoses, wires and other such apparatus parts are omitted from the diagrammatic showings of the principal parts, of the apparatus 150 in FIGS. 10-12, as are the supporting parts of the moving belt conveyor 140. Those skilled in the art will recognize that the illustrated parts of the invention can be supported in their operating positions by many different structures and that, although the illustrated principal parts of the apparatus 150 are preferably moved in their operation by compressed air motors, such as compressed air piston-cylinders, other forms of motors and actuators, such as hydraulic and electric motors and actuators can be used in the invention.

As illustrated by FIGS. 10-12, an apparatus 150 of the invention for automatically fastening the sand core elements of a core assembly together can include a first means 160 for intercepting and stopping movement of core assemblies along their path on the moving belt conveyor 140 at a predetermined position, a second means 170 for sensing the presence and absence of a core assembly at the pre-determined position, a third means 180 for lifting core assemblies from the predetermined position to a fastening position 146 (shown in dashed lines in FIG. 11) where the core elements will be fastened together, and for lowering the fastened assemblies to the moving belt conveyor, a plurality of means 190 for carrying and positioning a plurality of smooth surface fastener guns against core assemblies at the fastening position 146, means for operating the plurality of fastener guns when positioned adjacent the core assembly, and for sensing when fasteners have been inserted from each of the plurality of fastener guns, and a control 200 for operation of each of the afore-described means.

More specifically, a preferred apparatus 150 of the invention, for automatically stapling together a plurality of sand core elements in a casting core assembly carried on a moving belt conveyor, can comprise a stop 161 adapted for location adjacent the moving belt conveyor 140, a first motor 162 for moving the stop 161 between a stop position in the path of core assemblies being carried by the moving belt conveyor 140 and a pass position out of the path of core assemblies on the moving belt conveyor 140, a proximity sensor 170 located adjacent the stop position of stop 161, a reciprocatable lifting table 181, located below the moving belt conveyor, said reciprocatable table 181 having a plurality of lifting rods 182 extending upwardly from the lifting table to terminal ends 182*a* just below and on each side of the moving belt conveyor 140, said plurality of lifting rods 182 being sufficiently spaced apart on said reciprocatable table to reliably engage the underside of core assemblies carried by the moving belt conveyor 140, a lifting motor 183 for raising and lowering the reciprocatable lifting table 181, said lifting motor 183 driving said lifting table 181 upwardly so the plurality of lifting rods 182 extend above the level of the moving belt conveyor 180 and their terminal ends 182*a* define a fastening position 146 (shown in dashed lines in FIG. 11) for core assemblies, a pressure applying roof 184 (not shown in FIG. 10) above the lifting table 181 and moving belt conveyor 140 at the fastening position 146, said pressure-applying roof including resilient means 185 for engaging the upper side of a core assembly at the fastening position 146 to assist in retention of core assemblies at the staple insertion position, a plurality of movable carriers 191 for a plurality of staple guns 192, said plurality of movable carriers 191 being adapted to be driven between retracted positions and staple insertion positions adjacent core assemblies at the fastening position, a plurality of carrier drivers 193 for driving the plurality of movable carriers 191 between the retracted positions and staple insertion positions, each of the carriers 191 carrying a staple gun 192, a supply of staples 195, an actuator for operating the staple gun 196, and a staple sensor (not shown) on the staple gun for sensing insertion of staples from the staple gun, and a control 200 having first control means triggered by the proximity sensor 170 for operating the lifting motor 183 and moving the lifting table 181 upwardly so the terminal ends 182*a* of the lifting rods 182 define the fastening position 146, second control means for operating the plurality of carrier drivers 193 when the upward movement of the lifting table 181 ceases and moving the plurality of carrier drivers 193 to locate the plurality of staple guns 192 in their staple insertion positions, third control means for operating the staple gun actuators 196 when the carriers 191 have stopped at their staple insertion positions, fourth control means triggered by signals from the staple sensors on each staple gun for operating the lifting motor 183 lowering the lifting table 181 until the terminal ends 182*a* of the lifting rods 182 are below the level of the moving belt conveyor 140 and the fastened core assembly is placed on the moving belt conveyor 140, and for operating the first motor 162 so the stop 161 is at its pass position allowing the fastened core assembly to be carried from the fastening station 145 by the moving belt conveyor 140, and fifth control means triggered by said proximity sensor 170 when a fastened core assembly leaves the fastening station 145 for operating the first motor 162 to place stop 161 in the path of core assemblies on the moving belt conveyer 140.

In operation, the apparatus is operated by its control 200 so that as a core assembly being carried by the moving belt conveyor 140 is intercepted by stop 161, a signal from sensor 170 triggers the movement of the lifting table 181 upwardly so that shortly after the movement of the core assembly by the moving belt conveyor 140 has been interrupted, the terminal ends 182*a* of the lifting rods 182 engage the underside of the core assembly, lifting it upwardly to a pre-determined fastening position 146, at which the upward movement of the table is stopped and the core assembly is retained with the assistance of the resilient means 185, and almost immediately thereafter the staple gun carriers 191 are moved from their retracted positions to position the staple guns 192 adjacent the ends of the core assembly for insertion of a first set of staples. Preferably, each staple gun inserts a staple at more than one location. Where each of the staple guns inserts staples at more than one position, when insertion of the first staple has been completed, the staple gun is moved to its next position for insertion of a staple at its next position. Where each staple gun inserts staples at more than two positions on the core assembly, the repositioning of the staple gun is continued by the control 200 until all staples have been inserted in the core assembly. When all staples have been inserted into the core assembly, the carriers 191 are moved away from their staple insertion positions, the stop 161 is removed to its retracted pass position by the first motor 162, and the fastened core assembly is again placed on the moving belt conveyor 140 by the lifting table 181 and lifting motor 182 for movement downstream of the fastening station. When the fastened core assembly has been moved past the stop position of stop 161, sensor 170 triggers operation of motor 162 and the stop 161 is moved back to its stop position.

The third lifting means 180 can be any structure that can be moved upwardly to engage the underside of core assemblies without damaging them and lift the core assemblies to fastening position 146. The lifting table 181 can have a form other than rectangular, provided it will support lifting rods 182 in positions so that they will stably support the core assemblies at the fastening position 146. The lifting motor 183 is preferably operated by compressed air at such a rate that the lifting table is moved upwardly at a controlled rate so the terminal ends 182*a* of the lifting rods 182 will not damage the underside of the core assemblies when they are engaged. In the preferred apparatus of the invention the first stop means 160 comprises a U-shaped member 163 carried below the moving belt conveyer 140 by an air-operated motor 162, with upwardly extending legs 164 providing elastomeric stops on each side of the moving belt conveyor 140, and the U-shaped member 163 is moved upwardly by the motor 162 so its upwardly extending legs 164 are moved into position to intercept core assemblies being carried by the moving belt conveyor 140 and can be returned by motor 162 to the pass position where the upwardly extending legs 164 are below the level of the moving belt conveyor 140. The first stop means 160, however, can be any element that may be moved in and out of the path of core assemblies being carried by the moving belt conveyer 140 and engage the core assemblies without damaging them. The first stop means may be moved to and from the position at which it intercepts core assemblies on the moving belt conveyor 140 by any motor means 162, but is preferably operated by a compressed air piston-cylinder motor. While any form of sensor 170 can be used to sense the presence of a core assembly in the apparatus, a proximity sensor that does not engage the core assembly is preferred to reduce the risk of damage to the core assembly.

In the preferred apparatus of the invention, a plurality of positionable carriers 191 for automatically operable staple guns 192 are preferably provided on both the entrance end and exit end of the apparatus. The movable carriers 191 are carried by carrier drivers 193 and are movable toward and away from core assemblies that have been lifted from the moving belt conveyor 140 to the fastening position 146 so that the plurality of automatic staple guns may be positioned in one or more staple insertion positions adjacent both ends of the core assembly so that staples may be simultaneously inserted into adjacent core elements, avoiding unbalanced insertion forces being imposed on the core assemblies. The carrier drivers 193 can movably support and drive the staple gun carriers 191 between their retracted and staple-insertion positions by various means that are well-known in the art. The staple gun carriers 191 are preferably moved between their positions by compressed air cylinders in the carrier drivers 193. An automatic staple gun 192 is carried by each staple gun carrier and is mounted so its muzzle extends from the face of the carrier 191 adjacent the core assemblies so the carrier 191 will not interfere with their placement adjacent the ends of the core assemblies. Each carrier 191 also carries a spool 195 of staples that automatically feed the staple gun in its operation. The staple guns are preferably Types A20-6, manufactured by Heftsystem and using type MAGO coil staples, available in the United States from Allied Packaging Systems & Supplies, of Melrose, Ill.

Those skilled in the art will recognize that the illustrated parts of the apparatus 150 may be supported by many forms of structure and controlled by many forms of control apparatus. The control means may include relays and/or solid state controllers, and control valves for controlling the application of compressed air to the preferred air piston-cylinder motors The invention provides not only greater reliability and reduced assembly times, but also substantial material savings. In one application of the invention, the use of a staple costs 0.4 cents ($0.004) permitted the replacement of a core-interconnecting rod costing 30 cents ($0.30). In other applications, the invention permitted staples costing 0.4 cents ($0.004) to replace screws costing ($0.016). While these differences in cost may seem small, they become substantial in the manufacture of internal combustion engines in tens of thousands per year.

It is therefore intended that the foregoing detailed description be regarded as illustrative rather than limiting, and that it be understood that it is the following claims, including all equivalents, that are intended to define the spirit and scope of this invention.

We claim:

1. An apparatus for automatically stapling together a plurality of sand core elements in a casting core assembly carried on a moving belt conveyor, comprising:

a movable stop adapted for location adjacent the moving belt conveyor, a first motor for moving the movable stop between a stop position in the path of core assemblies carried on the moving belt conveyor and a pass position out of the path of core assemblies on the moving belt conveyor, a proximity sensor located adjacent the stop position of the movable stop, a reciprocatable lifting table located below the moving belt conveyor, said reciprocatable lifting table having a plurality of lifting rods extending upwardly from the lifting table to terminal end locations just below and on each side of the moving belt conveyor, said plurality of lifting rods being sufficiently spaced apart on said reciprocatable table to reliably engage the underside of casting core assemblies carried by the moving belt conveyor with the terminal ends of the lifting rods, a lifting motor for raising and lowering the reciprocatable lifting table, said lifting motor driving said lifting table upwardly so the plurality of lifting rods extend above the level of the moving belt conveyor and define with their terminal ends a fastening position for casting core assemblies carried thereby, a pressure-applying roof at the fastening position above the lifting table and moving belt conveyor, said pressure-applying roof including resilient means for engaging the upper sides of the core assemblies at the fastening position to assist in the retention of the core assemblies at the fastening position, a plurality of movable carriers for a plurality of staple guns, each of said plurality of movable carriers being adapted to be driven between a retracted position and a staple insertion position adjacent core assemblies at the fastening position, a plurality of carrier drivers for driving the plurality of movable carriers between their retracted positions and staple insertion positions, each of the movable carriers carrying a staple gun, a supply of staples, an actuator for operating the staple gun, and a sensor for sensing the insertion of staples from the staple gun, and a control having first control means triggered by said proximity sensor for operating the lifting motor and moving the lifting table upwardly so the terminal ends of the lifting rods define the fastening position, second control means for operating the plurality of carrier drivers when the upward movement of the lifting table ceases and moving the plurality of carrier drivers to locate the plurality of staple guns in their staple insertion positions, third control means for operating the staple gun actuators when the carriers have stopped at their staple insertion positions, fourth control means triggered by signals from the plurality of staple sensors for operating the lifting motor lowering the lifting table until the terminal ends of the lifting rods are below the level of the moving belt conveyor and for operating the first motor for moving the movable stop out of the path of core assemblies on the moving belt conveyor, and fifth control means triggered by the proximity sensor for operating the first motor to move the movable stop to its stop position.

2. An apparatus for automatically fastening together a plurality of assembled core sand elements in a core assembly carried on a moving belt conveyor, comprising a movable stop operable for intercepting, stopping and passing the movement of an assembly of core elements along their path on the moving belt conveyor at a pre-determined position, a proximity sensor for sensing the presence and absence of an assembly of core elements at the pre-determined position, a lifting table for lifting the assembly of core elements to a fastening position and for lowering a fastened core assembly to the moving belt conveyor, a plurality of carriers for carrying a plurality of staple guns between retracted positions and staple insertion positions adjacent The assembly of core elements at the fastening position for insertion of staples into the assembly of core elements, and a plurality of carrier sensors for sensing when the plurality of staple guns has inserted staples into the assembly of core elements, a controller for operating the moveable stop, the proximity sensor. the lifting table, the plurality of carriers, and the plurality of carrier sensors to place the moveable stop in the path of the assembly of core elements on the moving belt conveyor, to operate the lifting table when the proximity sensor senses a stopped assembly of core elements, to operate the plurality of carriers when the lifting table has lifted the assembly of core elements to the fastening position, to operate the plurality of staple guns after the plurality of staple guns have arrived at their staple insertion positions, to operate the lifting table when staples from the plurality of staple guns have been inserted into the assembly of core elements and lower the stapled assembly of care elements onto the moving belt conveyor and to remove the moveable stop from the path of the fastened core assembly on the moving belt conveyor, and to place the moveable stop in the path of core assemblies on the moving belt conveyor when the proximity sensor senses that a fastened core assembly has been moved from the pre-determined position.

3. The apparatus of claim 2 wherein the a movable stop is driven by a motor between a stop position above the level of the moving belt conveyor and a pass position below the level of the moving belt conveyor.

4. The apparatus of claim 3 wherein the movable stop comprises a U-shaped element having two upwardly extending legs with one upwardly extending leg located on each side of the moving belt conveyor, providing stops on each side of the moving belt conveyor, and a compressed air piston-cylinder motor to reciprocate the U-shaped element between the stop position and pass position.

5. The apparatus of claim 2 wherein the a lifting table is located below the moving belt conveyor, a plurality of lifting rods carried by the lifting table and extending upwardly to terminal ends just below the level of the moving belt conveyor, and a lifting motor for raising and lowering the lifting table, the terminal ends of said lifting rods defining the fastening position for core assemblies with the lifting table in its lifted position.

* * * * *